US008163213B2

(12) United States Patent
Cronburg

(10) Patent No.: US 8,163,213 B2
(45) Date of Patent: Apr. 24, 2012

(54) METHOD OF REDUCING CRIMP IN WOVEN SAILCLOTH

(75) Inventor: Terry Lee Cronburg, Coventry, CT (US)

(73) Assignee: Challenge Sailcloth Inc., Vernon, CT (US)

( * ) Notice: Subject to any disclaimer, the term of this patent is extended or adjusted under 35 U.S.C. 154(b) by 543 days.

(21) Appl. No.: 12/332,289

(22) Filed: Dec. 10, 2008

(65) Prior Publication Data

US 2010/0139061 A1 Jun. 10, 2010

(51) Int. Cl.
*B63H 9/06* (2006.01)
*D01D 10/02* (2006.01)
*D03D 25/00* (2006.01)

(52) U.S. Cl. ..... 264/103; 264/137; 264/232; 264/233; 264/340

(58) Field of Classification Search ..... 264/103, 264/137, 232, 233, 340
See application file for complete search history.

(56) References Cited

U.S. PATENT DOCUMENTS

| | | | | |
|---|---|---|---|---|
| 4,554,205 | A | 11/1985 | Mahr | |
| 4,590,121 | A | 5/1986 | Mahr | |
| 6,257,160 | B1 | 7/2001 | Keire | |
| 6,311,633 | B1 | 11/2001 | Keire | |
| 6,722,394 | B2 | 4/2004 | Harrison | |
| 7,419,561 | B1 | 9/2008 | Omohundro | |
| 2003/0091785 | A1 * | 5/2003 | Howland | 428/107 |
| 2004/0031534 | A1 * | 2/2004 | Schwartz | 139/169 |
| 2009/0062712 | A1 * | 3/2009 | Leuprecht | 602/44 |

FOREIGN PATENT DOCUMENTS

WO WO-2006063599 A1 * 6/2006

OTHER PUBLICATIONS

International Search Report for international application No. PCT/US08/86290 issued by the International Searching Authority mailed on Feb. 4, 2009.

Written Opinion of the International Searching Authority for international application No. PCT/US08/86290 issued by the International Searching Authority mailed on Feb. 4, 2009.

* cited by examiner

*Primary Examiner* — Leo B Tentoni
(74) *Attorney, Agent, or Firm* — Jeremy C. Lowe

(57) ABSTRACT

A method of reducing crimp in woven sailcloth comprising applying heat to warp yarn or fill yarn prior to the yarns being woven into fabric and a method of making a sail comprising assembling panels of sailcloth comprising warp yarns and fill yarns, wherein at least one panel of sailcloth is prepared by applying heat to the warp yarn or the fill yarn prior to the yarns being weaved into fabric.

15 Claims, No Drawings

METHOD OF REDUCING CRIMP IN WOVEN SAILCLOTH

TECHNICAL FIELD

The present disclosure relates to woven sailcloth and the reduction of crimp in such cloth.

BACKGROUND

"Crimp" is a term that is used to describe the waviness or nonlinearity of yarns in woven fabrics. Typically, such yarns have an "over and under" shape caused by weaving. The more crimp that is present in a woven fabric, the more the fabric will stretch. Stretchiness is an important consideration in the selection of a woven fabric as sailcloth. If sailcloth stretches too much, it loses it shape and is aerodynamically inefficient.

The sail-making industry has attempted to address the issue of crimp in a number of ways. For example, sailcloths have been laminated with one or more layers of nonwoven plastic film to minimize stretching of the sailcloth in the wind. Unfortunately, laminated sailcloths delaminate with age, use, and exposure to the elements. In addition, the laminating film tends to crease and shrink with use, thereby adversely affecting the shape of the sail.

Also in an effort to minimize stretching, sailcloth, which has been tightly woven from polyester yarns, has been impregnated with a resin and heated to cure the resin and shrink the polyester fabric. In order to construct sails from this cloth, numerous panels must be assembled to align the yarns will less crimp along directions of maximum stress or load in the sail so as to reduce stretch. Therefore, the disadvantage of this type of sailcloth is that it limits how panels can be cut and arranged in a sail, while still using the cloth efficiently.

Sailcloth also has been constructed with a reinforcing yarn to minimize stretching. The reinforcing yarn, which has a higher tensile modulus (e.g., above 500 grams/denier) than conventional yarn (tensile modulus of 20-100 grams/denier for Dacron or polyester), has been used to replace the conventional yarn every so many yarns in the warp and/or fill direction, while maintaining the denier (see, e.g., Bainbridge et al., U.S. Pat. No. 5,304,414). More recently, sailcloths have been woven from heat-shrinkable yarn with crimp imparted to the fill yarns, while leaving the warp yarns relatively uncrimped and while maintaining a high yarn density. The sailcloth is woven with more space between the warp yarns than conventional fabrics and a fill vs. warp weight ratio of between 1.0 to 1 and 0.22 to 1 (see, e.g., Mahr, U.S. Pat. No. 6,725,885).

More structured sails have been developed for racing. Fabric strips, which contain bundles of monofilaments, have been taped onto the skin or membrane of the sail along the load path in the sail. However, such sails have proved to have insufficient strength. Consequently, structural sails having a complex secondary structure in which the angles of warp yarns with respect to fill yarns vary in one panel relative to another panel have been proposed (see, e.g., Keire, U.S. Pat. No. 6,257,160). Separately, the use of pre-crimped fill yarn has been proposed to allow for warp yarn to remain predominantly straight with very little crimp (see, e.g., Cronburg, U.S. Pat. App. Pub. No. 2006/0157138).

In view of the above, the present disclosure seeks to provide a method of reducing crimp in woven sailcloth that provides fabric with straighter warp or fill yarns, yet is simple and easy to use. This and other objects and advantages, as well as inventive features, will become apparent from the detailed description provided herein.

SUMMARY

A method of reducing crimp in woven sailcloth comprising warp and fill yarns is provided. The method comprises applying heat to the warp yarn or the fill yarn prior to the yarns being woven into fabric, and weaving the warp yarn and the fill yarn into fabric.

A method of making a sail is also provided. The method comprises assembling panels of sailcloth comprising warp yarns and fill yarns, wherein at least one panel of sailcloth is prepared by applying heat to the warp yarn or the fill yarn prior to the yarns being weaved into fabric.

DETAILED DESCRIPTION

The present disclosure is predicated on the discovery that heat can be used to reduce crimp in warp yarns or fill yarns of woven fabric, in particular sailcloth. The fabric has straighter warp or fill yarns, respectively, with lower stretch.

The following terms are relevant to the present disclosure:

(a) "Yarn" and "yarns" are used herein to refer to any and all fibers, filaments, strands, and/or yarns of natural, synthetic, or composite (e.g., natural and synthetic) material that can be woven into a fabric, in particular sailcloth.

(b) "Warp" describes a yarn that runs lengthwise in a fabric.

(c) "Weft" describes a yarn that runs widthwise in a fabric. This yarn also may be referred to as a "fill" yarn.

(d) "Woven" describes a fabric that is made by weaving warp and fill yarns together, such as by operation of a loom. The warp and fill yarns cross over and under each other as the fabric is woven.

(e) "Crimp" describes the waviness or nonlinearity of yarns in woven fabrics (see, e.g., *Man-Made Fiber and Textile Dictionary*, Celanese Corporation). Crimp can occur in the warp and/or weft yarns. Factors, such as the relative thickness ("denier") of the yarns and the tension of the yarns, can affect crimp. A thinner yarn (lower denier) will crimp more than a thicker yarn (higher denier). Likewise, a yarn under less tension will crimp more than a yarn under more tension. Crimp can be measured by making gage marks on a woven fabric a set distance apart. For example, marks can be made about one meter apart along the length of the fabric. A warp yarn between two gage marks is then unraveled. The unraveled yarn is straightened out, and its length is measured. The length of the unraveled yarn in excess of the gage (in this example, in excess of one meter) is a measure of the crimp. If, for example, the unraveled warp yarn is 1.15 meters in length, it has a 15% crimp. The crimp in a weft yarn can be similarly measured between gage marks marked on a woven fabric a set distance apart along the width of the fabric.

(f) "Denier" is the weight in grams of a 9,000 meter length of yarn. The denier is proportional to the effective diameter of the yarn.

(g) "Plain weave" describes a manner of weaving in which warp yarns pass over and under weft (or fill) yarns.

(h) "Ripstop" describes a woven fabric in which a reinforcing yarn has been used at a designated interval, which can vary from one fabric to another and, if desired, within a single fabric. Depending on how the reinforcing yarn is incorporated, the woven fabric can take on a variety of textures, such as a box pattern. The presence of the reinforcing yarn makes the fabric difficult to rip; hence, the term "ripstop."

(i) "Density" of a fabric is determined by multiplying the square root of the yarn in denier by the yarn count per inch.

The above terminology may be used herein to describe one or more aspects of the present disclosure. The terminology is not intended to limit the scope of the claimed invention.

In view of the above, the present disclosure provides a method of reducing crimp in woven sailcloth comprising warp and fill yarns. The method comprises applying heat to the warp yarn or the fill yarn prior to the yarns being weaved into fabric and weaving the warp yarn and the fill yarn into fabric. Preferably, heat is applied to the warp yarn. The yarn is not crimped after heating and prior to being weaved into fabric (although the present disclosure contemplates the use of pre-crimped fill yarns, in which case the warp yarns are heated prior to being weaved into fabric). Heat can be applied at any time from when the yarn is still on the spool until the yarn is being weaved into the fabric. In this regard, heat can be applied to the yarn in any suitable manner.

Preferably, heat is applied to the yarn in the absence of excessive stress or tension on the yarn. For example, when the yarn is still on the spool, the yarn can be placed inside a heated container, such as a box or an oven. Alternatively or additionally, the yarn can be heated while being loaded on the loom or after it has been loaded onto the loom. For example, the yarn can pass through a heated tube, along the surface of one or more heated plates or rollers, and/or in front of heated air, such as that dispensed from a blower, a heater, or a heat gun, any of which is/are positioned along the path of the yarn.

Care must be taken to ensure that the yarn is not heated at or above its melting point. Preferably, the yarn is heated well below its melting point, and is heated only to a temperature necessary to increase its pliability. In this regard, heating yarn to a temperature of about 10° F. to about 20° F. above ambient temperature can be sufficient to increase the pliability of yarn without compromising its structural integrity. The amount of time required to heat the yarn sufficiently to increase its pliability can vary depending on when the yarn is heated. For example, more time can be required to heat yarn when it is wound on a spool as opposed to when it is unwound and ready to be woven. Unwound yarn can be sufficiently heated within seconds, whereas yarn that is wound on a spool can take minutes to heat sufficiently, depending on the type of yarn, its denier, and how much yarn is wound on the spool. Desirably, yarn wound on a spool is heated until the innermost layer of yarn on the spool is heated.

After the sailcloth has been woven, the fabric is allowed to cool. Then the sailcloth can be finished in accordance with methods known in the art. For example, it can be scoured (e.g., to remove any sizing and the like). Afterwards, it can be dipped into an aqueous bath of heat-curable resin, such as melamine, which serves to lock the woven geometry and decrease stretch. The fabric then can be dried and heat-set by passing through an oven or over large, heated, metal cylinders, such as cylinders heated to about 425° F., which causes the yarns to shrink, thereby increasing density. The fabric then can be calendared by passing the fabric between a pair of rollers under high pressure (e.g., 70 tons), with one of the rollers being heated. Instead of being heat-set with melamine, the fabric can be coated with polyurethane or the like. Afterwards, the edges of the fabric are typically slit, and the fabric is tubed off into rolls. These finishing methods are exemplary and are not intended to be limiting.

Any suitable yarn can be used. Examples of suitable yarns include, but are not limited to, polyester yarn, such as a Dacron-type polyester yarn, and polyamide yarn, such as a nylon yarn. The denier of a warp yarn preferably ranges from about 500 to about 3,000, whereas the denier of a weft/fill yarn preferably ranges from about 100 to about 1,000. Preferably, the warp density is from about 1,200 to about 1,800, whereas the weft/fill density is from about 800 to about 1,400.

While the yarn can be woven into any suitable weave, preferably the yarn is woven into a plain weave. If desired, a ripstop pattern can be incorporated into the weave. The method disclosed herein can incorporate other patterns of weave, and can be combined with other methods of making sailcloth that are known in the art, such as other techniques to reduce crimp or stretching. For example, pre-crimped, stretchable fill yarns can be woven with warp yarns, which have been heated in accordance with the disclosed method. See, e.g., Cronburg, U.S. Pat. App. Pub. No. 2006/0157138; see, also, Smith et al., U.S. Pat. No. 5,771,674 for a method of crimping fibers. Additionally or alternatively, fill yarns can be inserted into the loom at an angle off 90° relative to the warp yarns to reduce friction between the fill yarns and the warp yarns as the two are compressed together during weaving.

In view of the foregoing, a method of making a sail is also provided. The method comprises assembling panels of sailcloth comprising warp yarns and fill yarns, wherein at least one panel of sailcloth is prepared by applying heat to the warp yarn or the fill yarn prior to the yarns being weaved into fabric.

All patents, patent application publications, journal articles, textbooks, and other publications mentioned in the specification are indicative of the level of skill of those in the art to which the disclosure pertains. All such publications are incorporated herein by reference to the same extent as if each individual publication were specifically and individually indicated to be incorporated by reference.

The invention illustratively described herein may be suitably practiced in the absence of any element(s) or limitation(s), which is/are not specifically disclosed herein. Thus, for example, each instance herein of any of the terms "comprising," "consisting essentially of," and "consisting of" may be replaced with either of the other two terms. Likewise, the singular forms "a," "an," and "the" include plural references unless the context clearly dictates otherwise. Thus, for example, references to "the method" includes one or more methods and/or steps of the type, which are described herein and/or which will become apparent to those ordinarily skilled in the art upon reading the disclosure.

The terms and expressions, which have been employed, are used as terms of description and not of limitation. In this regard, where certain terms are defined at the beginning of the "Detailed Description" and are otherwise defined, described, or discussed elsewhere in the disclosure, all such definitions, descriptions, and discussions are intended to be attributed to such terms. There also is no intention in the use of such terms and expressions of excluding any equivalents of the features shown and described or portions thereof.

It is recognized that various modifications are possible within the scope of the claimed invention. Thus, it should be understood that, although the present invention has been specifically disclosed in the context of preferred embodiments and optional features, those skilled in the art may resort to modifications and variations of the concepts disclosed herein. Such modifications and variations are considered to be within the scope of the invention as defined by the appended claims.

What is claimed is:

1. A method of reducing crimp in woven sailcloth comprising warp and fill yarns, which method comprises applying heat to the warp yarn or the fill yarn prior to the yarns being woven into fabric, and weaving the warp yarn and the fill yarn into fabric, whereupon crimp in the woven sailcloth is reduced.

2. The method of claim 1, which comprises applying heat to the warp yarn only.

3. The method of claim 1, wherein the warp and fill yarns are separately selected from the group consisting of polyamide yarn and polyester yarn.

4. The method of claim 1, wherein the denier of the warp yarn ranges from about 500 to about 3,000.

5. The method of claim 1, wherein the denier of the fill yarn ranges from about 100 to about 1,000.

6. The method of claim 1, wherein the fabric is woven in a plain weave, optionally incorporating a ripstop pattern.

7. The method of claim 1, wherein the warp density is from about 1,200 to about 1,800.

8. The method of claim 1, wherein the fill density is from about 800 to about 1,400.

9. The method of claim 1, which further comprises scouring the sailcloth.

10. The method of claim 9, which further comprises dipping the sailcloth into an aqueous bath of heat-curable resin, drying the sailcloth, heat-setting the sailcloth, and calendaring the sailcloth.

11. The method of claim 10, wherein the heat-curable resin is melamine.

12. The method of claim 9, which further comprises coating the sailcloth with polyurethane.

13. The method of claim 2, which comprises using precrimped, stretchable fill yarn.

14. The method of claim 2, wherein the angle of the fill yarn relative to the warp yarn during weaving is other than 90°, thereby reducing friction between the fill yarn and the warp yarn as the two are compressed together during weaving.

15. A method of making a sail, which method comprises assembling panels of sailcloth comprising warp yarns and fill yarns, wherein at least one panel of sailcloth is prepared by applying heat to the warp yarn or the fill yarn prior to the yarns being weaved into fabric.

* * * * *